US007251435B2

(12) United States Patent
Ohgoshi et al.

(10) Patent No.: US 7,251,435 B2
(45) Date of Patent: Jul. 31, 2007

(54) DEVELOPING DEVICE AND PRINTING DEVICE

(75) Inventors: Toshihide Ohgoshi, Nara (JP); Fumito Mizoguchi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 183 days.

(21) Appl. No.: 11/059,503

(22) Filed: Feb. 17, 2005

(65) Prior Publication Data

US 2005/0180774 A1 Aug. 18, 2005

(30) Foreign Application Priority Data

Feb. 18, 2004 (JP) ..... 2004-042045

(51) Int. Cl.
*G03G 15/08* (2006.01)

(52) U.S. Cl. ..... 399/103

(58) Field of Classification Search ..... 399/102–106
See application file for complete search history.

(56) References Cited

U.S. PATENT DOCUMENTS 5,212,521 A 5/1993 Ogawa et al.
5,424,814 A * 6/1995 Suzuki et al. ..... 399/284
5,585,895 A 12/1996 Yashiro et al.
5,991,568 A * 11/1999 Ziegelmuller et al. ..... 399/102
6,658,223 B2 * 12/2003 Nishimura et al. ..... 399/102

FOREIGN PATENT DOCUMENTS

JP 4-249273 A 9/1992
JP 6-130804 A 5/1994
JP 8-146761 A 6/1996

OTHER PUBLICATIONS

Translation of Sewa JP 08-146761.*

* cited by examiner

*Primary Examiner*—David M. Gray
*Assistant Examiner*—Ryan Gleitz
(74) *Attorney, Agent, or Firm*—Nixon & Vanderhye, P.C.

(57) ABSTRACT

A developing device is provided, in which respective lateral ends (the portions overlapped with the side seals 27) of the front seal board 23 are adhered/fixed to the side seals 27. More specifically, the gap between the both sides A1 and the return edge A2 of the opening section A of the toner tank 49 and the developing roller is sealed by a single plane composed of the side seals 27 and the front seal board 23 that are combined with each other. On this account, there is no gap between the side seal 27 and the front seal board 23 due to vibration caused by external force, time degradation etc. (i.e., it prevents the side seals 27 to be away from the front seal board 23). On this account, toner leakage can be securely prevented even when the developing device is driven for a long period of time or when some kind of vibration is applied to the development device.

20 Claims, 6 Drawing Sheets

DEVELOPING DEVICE AND PRINTING DEVICE

This Nonprovisional application claims priority under 35 U.S.C. § 119(a) on Patent Application No. 2004/042045 filed in Japan on Feb. 18, 2004, the entire contents of which are hereby incorporated by reference.

TECHNICAL FIELD

The embodiments disclosed herein relate to a developing device, provided in a printing device, for developing an electrostatic latent image to form a visible image.

BACKGROUND

A conventional electrophotographic printing device (image forming device) includes a photoconductive drum (image carrying body), a charging device, an exposing device, a developing device, a transferring device, and a fixing device.

In such a printing device, the photoconductive surface of the photoconductive drum is subjected to charging and exposure so as to form an electrostatic latent image formed thereon, and the formed latent image is then developed by toner (developer), thereby forming a toner image (visible image). Further, the toner image is transferred onto a sheet (recording medium: a printing medium like a general paper, an OHP sheet etc.), followed by thermal fixing.

Further, the developing device of the printing device generally includes a toner containing tank (toner tank) for keeping the toner. The toner tank has a function of charging the contained toner for development through friction charging or charge injection.

Further, a developing roller is provided in the opening section of the toner tank. The developing roller rotates in contact with the photoconductive drum, with the toner adhered thereon, thereby serially (continuously) adhering the toner onto the surface of the photoconductive drum. In the vicinity of the developing roller, a blade (layer thickness controlling member) is provided to flatten the toner layer on the roller surface.

Here, when the toner is not adhered to the photoconductive drum, the toner is brought back to the toner tank and re-collected therein.

For this function, a toner leakage preventing mechanism is provided between the toner tank and the developing roller. The toner leakage preventing mechanism functions as a through pass (from outside to inside) of the collected toner, and also functions to prevent leakage (efflux from inside to outside) of the toner.

FIG. 5 is an explanatory view illustrating a structure of a conventional toner leakage preventing mechanism. As shown in the figure, in this structure, a developing roller 121 is designed to be set in the opening section of the toner tank 124, being rotatable in the H-direction. With this arrangement, the toner leakage preventing mechanism brings the toner having not been adhered to the photoconductive drum (not shown) back into the toner tank 124 through a lower portion (return entrance) of the opening section. Further, in the vicinity of the return entrance, side seals 127 and a front seal board 123 are provided as the toner leakage preventing mechanism.

The side seals 127 are sealing members fixed to the respective sides of the return entrance of the toner tank 124 by double-face adhesive tape or the like. Further, the side seals 127 come in contact with the developing roller 121 with its flexibility, thus preventing leakage of the toner through the end portion of the developing roller 121.

The front seal board 123 is an elastic sheet provided in a lower portion of the return entrance along the longitudinal direction of the developing roller 121. Further, the lower end (lower edge) of the front seal board 123 is fixed to the toner tank 124 while the upper end (upper edge) thereof is a free end. Further, the upper portion is pressed into the developing roller 121, covering the return entrance. With such a front seal board 123, leakage of toner from the lower portion of the return entrance is prevented.

Note that both ends of the front seal board 123 are overlaid on the respective surfaces of the side seals 127.

In regard to such a toner leakage preventing mechanism, Document 1 (Japanese Laid-Open Patent Application Tokukaihei 06-130804/1994 (published on May 13, 1994) discloses a structure in which the surface of the toner tank, that fixes the front seal board, and the surface of the side seal form a continuous plane. This structure is aimed at preventing flexion of the front seal board by the side seal.

In the foregoing mechanism, a stronger force (contact force) of pressing the front seal board and the side seal into the developing roller more securely prevents the leakage of toner.

However, if the force is excessively large, it blocks the through pass for collecting toner, and the running torque of the developing roller needs to be increased. Further, when the developing device is used for a long period of time, such a strong pressing force may induce breakages of the front seal board, the side seal, the toner tank, and/or the developing roller.

Accordingly, the contact force is generally set to a small value that is great enough to seal a gap between the front seal board and the developing roller.

However, with such a small contact force, there is a possibility of generation of a slight gap between the front seal board and the side seal when vibration and/or impact is applied upon shifting of the printing device, or due to secular distortion or the like, thereby causing leakage of toner.

Other possible strategies to prevent such toner leakage may be separation of the toner containing tank from the developing device, or sealing of the opening section of the toner containing tank by a sheet when the printing device is shifted.

However, such separation of the toner containing tank, sealing of the opening section or the like in shifting the printing device required is highly troublesome.

Further, in actual operation, the foregoing methods for preventing leakage of toner may be performed only with respect to a mint (unused) developing device. This is because, once toner is adhered to the developing roller, prevention of leakage of toner cannot be guaranteed.

Further, to adopt the foregoing methods, the toner containing tank needs to be made removable. Otherwise, the opening section needs to be made with a sheet to cover itself as required. Therefore, a complex structure (sealing structure in particular) has to be made between the toner containing tank and the developing roller.

SUMMARY

An object of the exemplary embodiments disclosed herein is to provide a developing device capable of easily preventing toner leakage between the front seal board and the side seals.

In order to solve the foregoing problems, the developing device of certain exemplary embodiments is a developing device for developing a latent image by obtaining developer from an opening section of a developer tank by a developing roller that is provided in a printing device, covering the opening section from outside of the developer tank, wherein: the developing device comprises: a seal mechanism for sealing a gap between the developing roller and the opening section, the seal mechanism including (a) side seals provided on both lateral sides of the opening section while being in contact with the developing roller, and (b) a front seal board whose one end covers an edge of the opening section and is fixed thereto, which edge extends in a longitudinal direction of the developing roller, the front seal board coming in contact with a surface of the developing roller between the opening section and the developing roller, when the developing roller returns to the opening section, and the front seal board being fixed to the side seals by its end sections.

The developing device of the exemplary embodiments is used for an electrophotography device, such as a photocopier, printer, facsimile etc. That is, the device of the exemplary embodiments develops a latent image (electrostatic latent image), that is formed on a latent image carrying body (e.g. photoconductive drum) provided in a printing device, so as to form a visible image.

Therefore, the device includes a developer tank for containing developer. Further, the developing roller of the device covers the opening section of the developer tank from outside of the tank. The developing roller supplies toner to the latent image carrying body for development of a latent image.

More specifically, the developing roller rotates between the opening section of the toner tank and the latent image carrying body, and the toner supplied (adhered) to the surface of the developing roller through the opening section is supplied to the latent image on the latent image carrying body by this rotation of the developing roller.

Note that, after the development, the surface (the surface having been supplied the developer to the latent image; return surface) of the developing roller is brought back to the opening section of the developer tank.

However, in this structure, a tiny gap is generated between the opening section of the developer tank and the developing roller. Therefore, the gap needs to be sealed to prevent leakage of developer.

The device of an exemplary embodiment therefore includes a seal mechanism to seal the gap.

In the whole gap between the opening section and the developing roller, two gap portions particularly need to be sealed: a gap on each lateral side of the opening section, and a gap generated on the return edge (described later) of the opening section.

Here, the former gap (the lateral gaps) indicates two gaps existing in the longitudinal direction (the direction to which the rotation axis extends) of the developing roller.

Meanwhile, the latter gap (return gap) indicates a gap existing in the longitudinal direction of the developing roller, which gap is created between the return surface of the developing roller and the edge (return edge) of the opening section that is closely in contact with the return surface of the developing roller.

In this view, the seal mechanism of the device of an exemplary embodiments includes side seals for covering the lateral gaps, and the front seal board for covering the return gap.

The side seals are fixed to the lateral ends (respective ends of the developing roller in the longitudinal direction (axis direction)) of the opening section while being in contact with the developing roller. This arrangement prevents leakage of developer through the two lateral gaps.

On the other hand, one side of the front seal board is fixed by covering the return edge of the opening section. Further, the front seal board comes in contact with the return surface of the developing roller between the developer tank and the developing roller.

As described, in the device of an exemplary embodiment the front seal board is in contact with the return edge of the opening section and the developing roller, thereby sealing the gap between the return edge and the developing roller.

The side seals and the front seal board are adhered to each other.

More specifically, in this device, both sides and the return edge of the opening section of the developer tank are covered by a continuous plane (uniform plane) composed of the two seal sections. On this account, there is no gap between each side seal and the front seal board, thereby preventing leakage of developer through the gap.

Further, particularly in this device, the two lateral end sections of the front seal board are fixed to the side seals.

More specifically, in the device of an exemplary embodiment, the gaps between the developing roller and the respective lateral portions of the opening section of the developer tank and the return edge are sealed by a unified plane composed of the side seals and the front seal board that are adhered to each other.

Therefore, in this device, there is no gap between the side seals and the front seal board due to vibration caused by external force, time degradation etc. (i.e., it prevents the side seals to be away from the front seal board).

On this account, in this device, toner leakage can be securely prevented even when the device is driven for a long period of time or when some kind of vibration is applied to the device (or to the printer including the device).

Additional objects, features, and strengths of the exemplary embodiments will be made clear by the description below. Further, the advantages of the exemplary embodiments will be evident from the following explanation in reference to the drawings.

DESCRIPTION

One embodiment will be described below.

Figure 2:
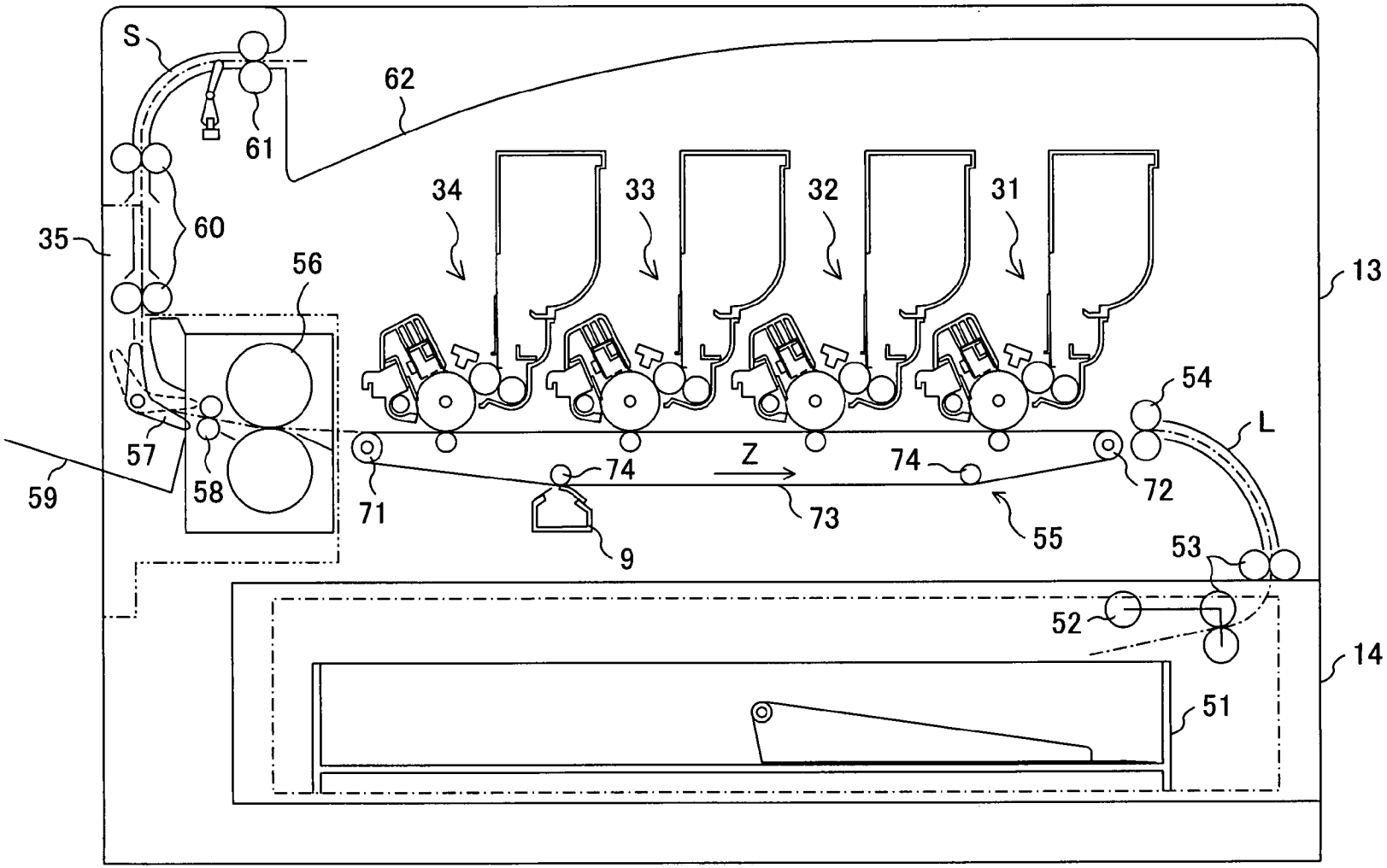
FIG. 2 is an explanatory view illustrating a structure of the printer according to an exemplary embodiment.

FIG. 2 is an explanatory view illustrating a structure of a digital color printer (the printer according to the present embodiment; printing device). This printer prints a full-color image onto a sheet (printing paper) based on externally-supplied full-color image data, and then outputs the sheet.

Further, as shown in FIG. 2, the printer according to the present embodiment includes an image forming section 13 and a paper feeding mechanism 14, and a control panel (not shown).

The image forming section 13 serves to print an image on a sheet based on image data. Further, as shown in FIG. 2, the image forming section 13 is constituted of a black image transfer section 31, a yellow image transfer section 32, a magenta image transfer section 33, and a cyan image transfer section 34.

The transfer sections 31 through 34 are practically identical in structure, and they transfer a black image, a yellow image, a magenta image, and a cyan image, respectively, to a sheet based on image data.

Figure 3:
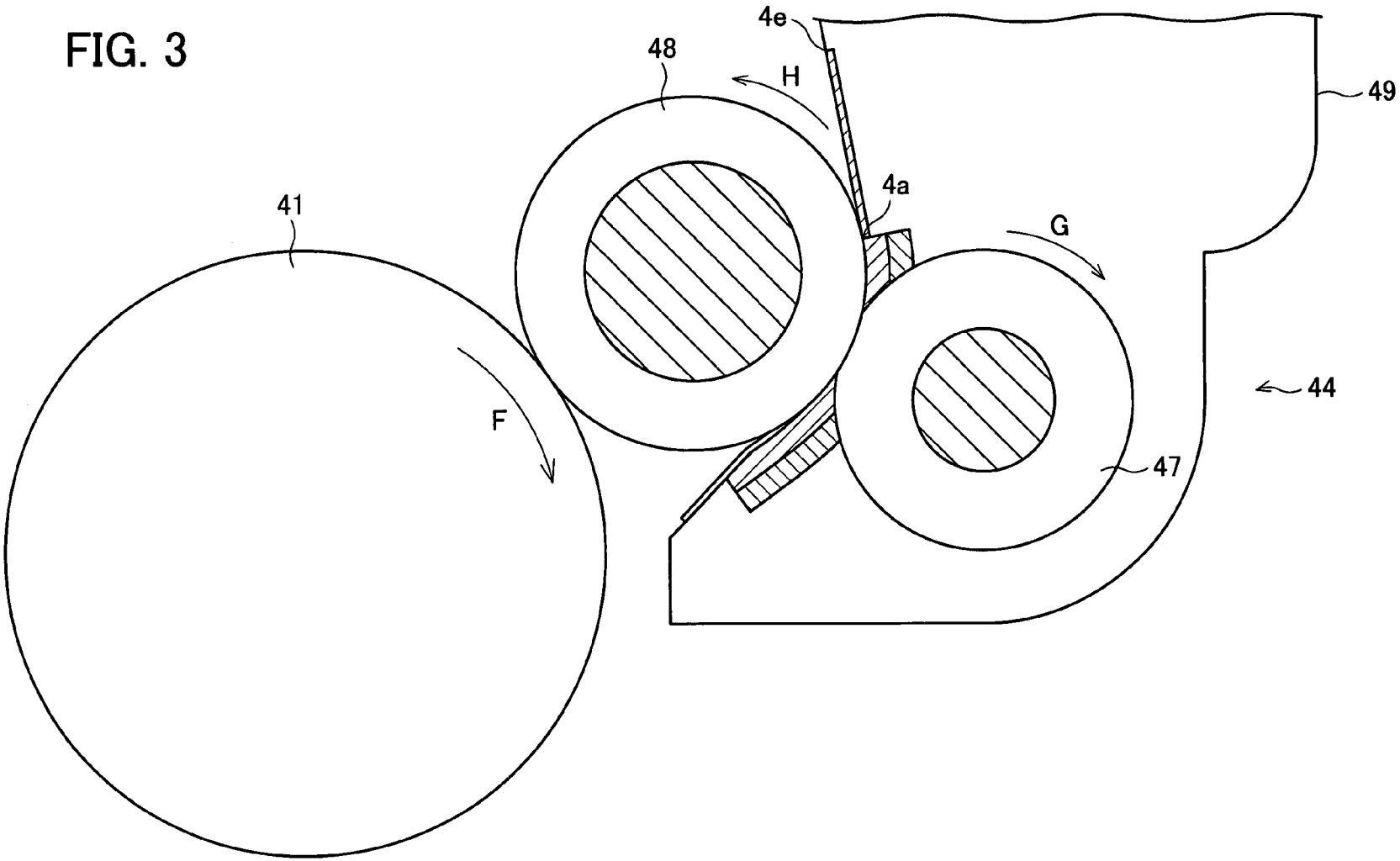
FIG. 3 is a side view of the developing device provided in the printer of FIG. 2.

FIG. 3 is an explanatory view illustrating a minute structure of the transfer sections 31 through 34. As shown in the figure, the transfer sections 31 through 34 each has a photoconductive drum 41, that is surrounded by a charging device, a LSU, a developing unit 44, a transfer roller and a cleaning device along the direction indicated by the arrow F.

The photoconductive drum (latent image carrying body) 41 is a drum-shaped transfer roller having a photoconductive material on its surface. The photoconductor drum 41 is driven by being rotated in the F arrow direction.

Further, the charging device is a charger-type corona discharger for equally (evenly) charging the surface of the photoconductive drum 41.

The LSUs (Laser-beam Scanner Unit) of the transfer sections 31 through 34 are supplied with image signals corresponding to a black component, a yellow component, a magenta component and a cyan component, respectively. Further, the LSUs carry out exposure of the photoconductive drums 41 of the transfer sections 31 through 34 based on the image signals, thereby forming electrostatic latent images.

The LSU includes an LED head (optical line head; not shown).

The LED head includes a substrate having an LED array and a driver for driving the LED, a SEL FOC® lens for condensing light of the LED array, etc. Further, the LED head has a function of exposing the photoconductive drum 41 by causing the LED array to emit light according to the image signals.

The developing units (developing device) 44 of the transfer sections 31 through 34 respectively have black toner, yellow toner, magenta toner and cyan toner. With these color toners, the developing unit (developing unit) 44 develops an electrostatic latent image formed on the photoconductive drum 41, thereby forming a toner image.

The structure of the developing unit 44 will be described later.

The transfer roller is a discharger for applying a transfer bias to the sheet so as to transfer the toner image thus formed on the photoconductive drum 41 onto the sheet. The transfer roller is rotatably supported by a transfer roller attachment section in a housing of a transfer carriage belt mechanism (transfer belt unit) 55.

The cleaning unit serves to remove remaining toner on the photoconductive drum 41 after the transfer of the toner image to the sheet.

Further, the paper feeding mechanism 14 shown in FIG. 2 serves to carry a sheet to a predetermined position to enable the image forming section 13 to transfer of the toner image on the sheet. Further, the paper feeding mechanism 14 has a function of outputting sheet to outside the printer after the transfer of the toner image.

As shown in FIG. 2, the paper feeding mechanism 14 includes a sheet cassette 51, a fetch roller 52, a plurality of carriage rollers 53 and 60, a resist roller 54, a resist pre-detection switch (not shown), a transfer carriage belt mechanism 55, a fixing device 56, a belt cleaner 9, a carriage direction switching gate 57, output rollers 58 and 61, and output trays 59 and 62.

The sheet cassette 51 keeps stock of sheets used in the printer. The fetch roller 52 is a pick-up roller (pulling roller) for outputting the sheets from the sheet cassette 51 one by one.

The carriage roller 53 transmits a sheet outputted from the sheet cassette 51 to the main marriage path L, allowing the sheet to be carried thereon. Specifically, the carriage roller 53 is a small roller for promoting/supporting carriage of sheet. A plurality of such a carriage roller 53 is provided along the main carriage path L.

The resist pre-detection switch detects passing of the sheet carried by the carriage roller 53 through a predetermined position on the main carriage path L, and outputs a predetermined detection signal.

The resist roller 54 temporarily holds the sheet carried through the main carriage path L. Then, the resist roller 54 transmits the sheet into the transfer carriage belt mechanism 55 according to the timing of actions of the transfer sections 31 through 34 so that the toner image on the photoconductive drum 41 is properly transferred onto the sheet.

More specifically, the resist roller 54 is arranged to send the sheet to the transfer carriage belt mechanism 55 based on a detection signal from the resist pre-detection switch so that the front edge of the toner image of the photoconductive drum 41 is pressed into the front end of the print range of the sheet.

As shown in FIG. 2, the transfer carriage belt mechanism 55 includes a driving roller 71, a driven roller 72, a carriage belt 73, suction charger (not shown), discharger (not shown), and an auxiliary roller 74.

The carriage belt 73 is hung between the driving roller 71 and the driven roller 72, in contact with the photoconductive drums 41 of the transfer sections 31 through 34, and is operated by friction drive in the direction denoted by the arrow Z by the driving and driven rollers 71 and 72. Further, the sheet transmitted by the resist roller 54 is electrostatically adhered to the carriage belt 73, which carries the sheet to the transfer sections 31 through 34 and the fixing device 56.

The suction charger is a brush provided between the black image transfer section 31 and the resist roller 54 to charge the surface of the carriage belt 73. More specifically, the printer of the present embodiment achieves prevention of misalignment of the sheet by charging the carriage belt 73 to electrostatically attract the sheet.

The discharger is provided between the image transfer section 34 and the fixing device 56 to discharge the surface of the carriage belt 73 with an alternating current.

More specifically, the toner images of respective colors are individually transferred onto the sheet carried to the transfer sections 31 through 34, and are superimposed with each other. Then, after the toner image from the cyan image transfer section 34 is completed, the sheet is separated from the carriage belt 73 from the front end, and then is carried to the fixing device 56.

The fixing device 56 performs thermal fixing of the toner image, that has been transferred onto the sheet without being fixed. Then, the sheet with the thermally fixed toner image is then carried to the carriage direction switching gate 57.

More specifically, the fixing device 56 includes a heat roller and pressure roller. Further, these two rollers rotate with the sheet therebetween, thereby thermally compressing the sheet.

The belt cleaner 9 includes a cleaning member (cleaning blade or the like; not shown) that is provided in contact with the transfer belt 73, so as to remove/collect the remaining toner on the surface of the carriage belt 73. With this member, the rear surface of the sheet is protected from being stained by the remaining toner on the carriage belt 73.

The switching gate 57 serves to allow selection between an output path connected to an output tray 59 provided on the lateral face of the printer, and a sub-carriage path S, so as to switch the carriage path of the fixed sheet. Note that, the switching gate 57 is rotatably attached to the lateral cover 35.

The sheet carried to the output tray 59 is outputted to the output tray 59 by the output roller 58. Further, the sub-carriage path S serves to output the sheet to an output tray 62 provided on an upper portion of the image forming section 13. More specifically, the sheet transmitted to the sub-carriage path S is carried on the sub-carriage path S by the carriage roller 60, and is outputted to the output tray 62 by the output roller 61.

Next, the following describes the structure of the developing unit 44.

The toner used in the developing unit 44 is negatively-charged nonmagnetic toner made of a single component and having high resistance, whose average particle diameter is 7.5 μm. As shown in FIG. 3, the developing unit 44 includes a toner tank (developer tank, developer container) 49 for keeping the toner, and a toner supply roller 47 provided inside the toner tank 49.

Further, on a lower portion of the toner tank 49, an opening section A (FIG. 4) is formed as the way out of the toner tank. Further, the toner supply roller 47 and the developing roller 48 explained above are provided having the opening section A therebetween.

The toner supply roller 47 is a rotation roller made of an expandable and elastic rubber material having a cylindrical shape. The toner supply roller 47 is provided in the toner tank 49, opposite to the developing roller 48.

A predetermined bias voltage is applied to the toner supply roller 47 to adhere/hold the toner kept in the toner tank 49. Further, the toner supply roller 47 rotates with the toner adhered thereto at a peripheral speed of 0.5 with respect to the peripheral speed of the developing roller 48 in opposite direction (G direction) of the rotation direction (H direction) of the developing roller 48, and comes in contact with the developing roller 48, thereby supplying the toner to the surface of the developing roller 48.

The developing roller 48 is a rotation roller made of a conductive rubber elastic material having a cylindrical shape. The developing roller 48 is provided to be opposite to the photoconductive drum 41 while covering the opening section A of the toner tank 49, and is supplied with a predetermined developing bias voltage.

The developing roller 48 rotates with the toner layer, that is formed by the toner supply roller 47 and is adhered thereto, in an opposite direction (H direction) of the rotation direction (F direction) of the photoconductive drum 41, and comes in contact with the photoconductive drum 41, thereby adhering toner to the electrostatic latent image on the photoconductive drum 41. The developing roller 48 then develops (reversal development) the electrostatic latent image, thereby forming the toner image.

Further, the developing roller 48 brings the toner (residual toner) having not been adhered to the electrostatic latent image back to the toner tank 49 from a lower portion of the opening section A of the toner tank 49.

More specifically, after the development, the surface (the face having been in contact with the photoconductive drum 41; return surface) of the developing roller 48 is brought back to the opening section A of the toner tank 49 by the rotation of the development roller 48. The residual toner on the return surface of the developing roller is adhered to the toner supply roller 47 and is re-collected in the toner tank 49.

Further, a layer thickness control member 4 is formed on the upper end of the opening section A of the toner tank 49. With this member, the thickness and charging quantity of the toner layer formed on the developing roller 48 by the toner supply roller 47 are adjusted.

Further specifications of the toner, the layer thickness control member 4, the toner supply roller 47 and the developing roller 48 used in the printer are described later in detail.

Next, the following describes a seal mechanism that is a distinctive structure of the developing unit 44.

The seal mechanism serves to prevent leakage of toner from the gap between the opening section A of the toner tank 49 and the developing roller 48. The seal mechanism includes side seals 27 and a front seal board 23 that are provided in the vicinity of the opening section A. The side seal 27 and the front seal board 23 are described later.

Figure 4:
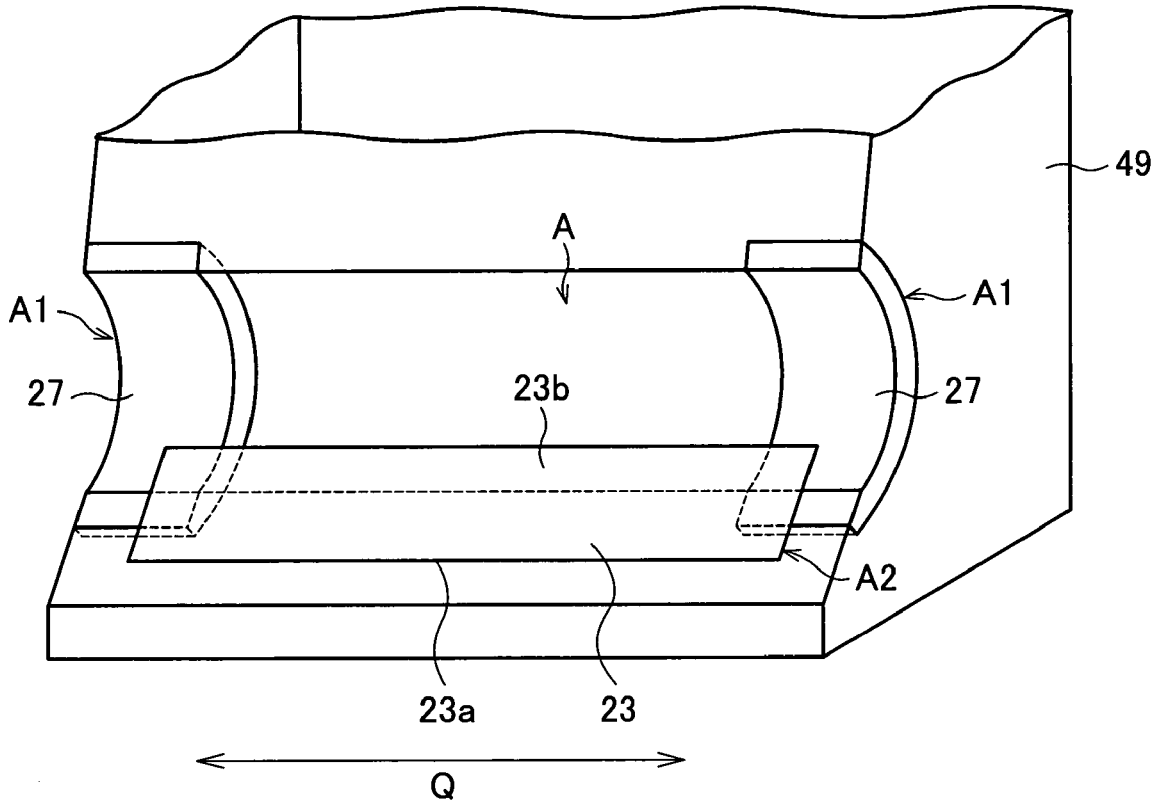
FIG. 4 is a perspective view illustrating a vicinity of the opening section of a toner tank in an exemplary embodiment when the developing roller is removed.
Figure 5:
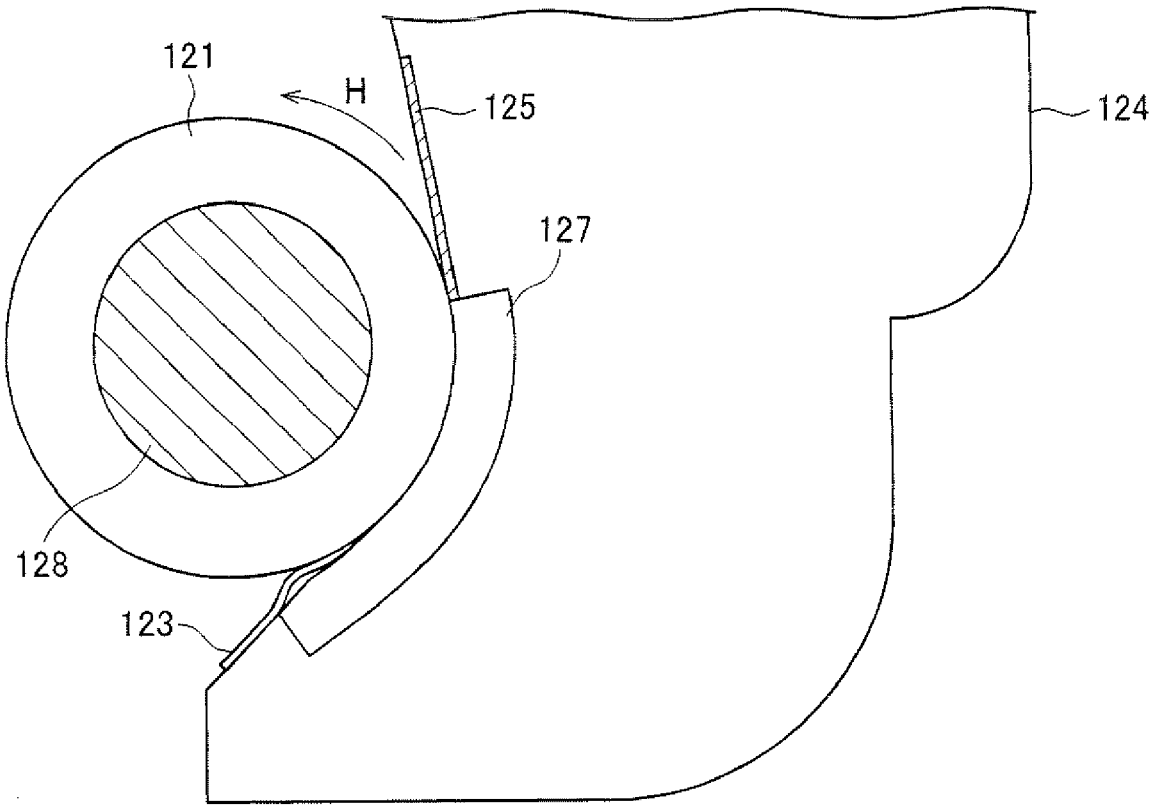
FIG. 5 PRIOR ART
FIG. 5 is a side view of a conventional developing device.

FIG. 4 is a perspective view illustrating a vicinity of the opening section A in the toner tank 49 when the developing roller 48 is removed.

Figure 1:
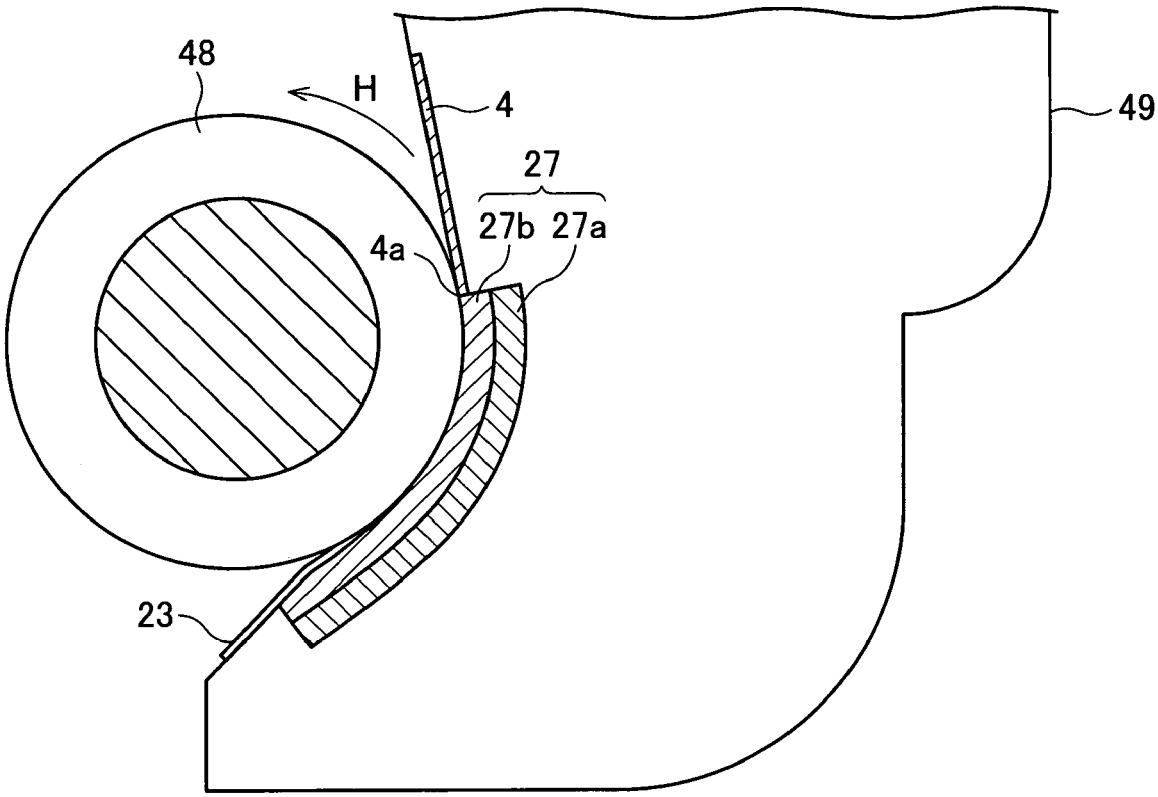
FIG. 1 is a cross-sectional view illustrating a vicinity of the opening section in a developing device provided in a printer according to an exemplary embodiment. This figure is viewed from the side of the device (axial direction of the developing roller).

Further, FIG. 1 is a cross-sectional view illustrating a vicinity of the opening section A, viewed from the lateral direction (axial direction of the developing roller 48).

As shown in the figure, in the toner tank 49, the face opposite to the developing roller 48 is curved along the shape of the developing roller 48. Then, on this curved face, the rectangle opening section A described above is formed.

Further, the side seal 27 is formed on each of the curved sides A1 of the opening section A (the longitudinal sides of the development roller 48: the sides in the axial direction; the direction Q shown in FIG. 4) of the opening section A.

The side seal 27 is fixed to each of both sides A1 of the opening section A by a double face adhesive tape. As shown in FIG. 1, the side seal 27 is made of a urethane foam 27*a* that has a flocked fabric 27*b* laminated thereon.

The urethane foam 27*a* is a closed-cell foam with a width=5.0 mm, a thickness=2.0 mm, cell density=40 cell/25 mm, hardness=about 20 kgf (JIS standard). The thickness of the flocked fabric 27*b* is 11.0 mm.

Further, the side seal 27 is pressed into the developing roller 48 by its elasticity with the flocked fabric 27*b* in contact with the developing roller 48.

Further, as shown in FIG. 4, the lower end of the opening section A extending along the longitudinal direction of the developing roller 48 is an edge (return edge) A2 that closely comes in contact with the return surface of the developing roller 48. Further, the front seal board 23 is formed on the return edge (seal board fixing plane) A2, by covering the return edge A2.

The front seal board 23 is a flexible thin board made of polycarbonate with a thickness=0.13 mm, and Young's modulus=2.07 Mpa. Each lower edge 23*a* of the front seal board 23 is fixed to the return edge A2 by a double face adhesive tape.

Further, the front seal board 23 is in contact with the return surface of the developing roller 48 with its elasticity, and each upper edge 23*b* (edge opposite to the lower edge 23*a*) thereof is caught between the toner tank 49 and the developing roller 48.

The fixed position of the front seal board 23 on the return edge A2 is 4.5 mm away from the contact point of the developing roller 48 and the front seal board 23.

Further, the close contact portion (the contact portion with the developing roller 48) of each upper edge 23*b* of the front seal board 23 is lightly in contact with the developing roller 48 with a linear pressure=0.12N/cm. With this pressure, the front seal board 23 is curved inward with respect to the opening section A by 0.7 mm.

Further, the length of the front seal board 23 in the Q direction is determined so that both ends thereof near the upper edge 23*b* are overlaid on the surface of the side seals 27.

With this arrangement, as shown in FIG. 1, the both ends of the front seal board 23 are caught between the developing roller 48 and the side seal 27.

Note that the compression quantity of the side seal 27 is set to a value great enough to lightly press both ends of the front seal board 23 into the developing roller 48. This prevents both ends of the front seal board 23 from being deformed by the compression, allowing the front seal board 23 to be evenly in contact with the developing roller 48.

Further, both ends (the ends near the upper edge 23*b*) of the front seal board 23, which are placed on the side seal 27, are overlaid on the side seal 27, and are adhered to the side seal 27 by a double face adhesive tape.

In the seal mechanism having such a structure, the developing roller 48 is compressed to the two side seals 27. On this account, the gap (side gap; the gap on a side of the direction Q) created between the developing roller 48 and the both sides A1 of the opening section A is sealed.

Further, an edge (lower edge) 23*a* of the front seal board 23 is fixed to the return edge A2 of the opening section A, while a vicinity of the other edge (upper edge) 23*b* is in contact with the developing roller 48.

On this account, the gap extending along the direction Q in a lower portion of the developing roller 48 (the gap between the return surface of the developing roller 48 and the return edge of the opening section A) is sealed.

In the seal mechanism with this structure, the gap between the developing roller 48 and the opening section A is completely sealed, thereby preventing leakage of toner through the gap.

Further, in this seal mechanism, the return surface of the developing roller 48 slightly (0.7 mm) presses the front seal board 23 downward with respect to the opening section A (i.e., the front seal board 23 is slightly bent) by rotation (in H direction) of the developing roller 48. With this arrangement, the residual toner on the return surface is brought back to the toner tank 49 by the rotation of the developing roller 48.

Further, each side seal 27 and the front seal board 23 are closely in contact with each other.

Therefore, in this seal mechanism, sides A1 and the return edge A2 of the opening section A of the toner tank 49 are covered by a continuous plane (uniform plane) composed of the side seals 27 and the front seal board 23. On this account, there is no gap between each side seal 27 and the front seal board 23, thereby preventing leakage of toner through the gap.

Further, particularly in this seal mechanism, both ends (the region overlapped with the side seal 27) of the upper edge 23*b* of the front seal board 23 are adhered/fixed to the respective side seals 27.

More specifically, in this seal mechanism, the gap between both sides A1 and the return edge A2 of the opening section A of the toner tank 49 and the developing roller 48 is sealed by a single plane composed of the side seals 27 and the front seal board 23 that are combined with each other.

Therefore, in this seal mechanism, there is no gap between the side seal 27 and the front seal board 23 due to vibration caused by external force, time degradation etc. (i.e., it prevents the side seals 27 to be away from the front seal board 23). On this account, toner leakage can be securely prevented even when the developing unit 44 is driven for a long period of time or when some kind of vibration is applied to the development unit 44 (or to the printer).

Further, in this seal mechanism, both side ends of the front seal board 23 are overlaid on the side seals 27. With this structure, the fixing plane (contact plane) of the side seals 27 and the front seal board 23 becomes larger than the structure in which the respective ends of the side seals 27 and the front seal board 23 are fixed to each other, thereby firmly fixing their ends.

Further, in the seal mechanism, the front seal board 23 is made of a polycarbonate thin board with Young's modulus=1.0 Mpa.

With this material, it is possible to prevent deformation (deformation in Q direction) of the front seal board 23 due to compression of the side seals thereinto.

Note that, to ensure prevention of the deformation, Young's modulus of the front seal board 23 is preferably not less than 1.0 MPa.

Further, the developing unit 44 performs development by using a single component toner (single-component development). In this case, the contact pressure of the front seal board 23 with respect to the developing roller 48 is preferably set to 0.2N/cm or less.

With this arrangement, the residual toner on the return surface of the developing roller 48 will not be raked by the front seal board 23, and the developing roller 48 securely returns (collects) the remaining toner into the toner tank 49.

Figure 6:
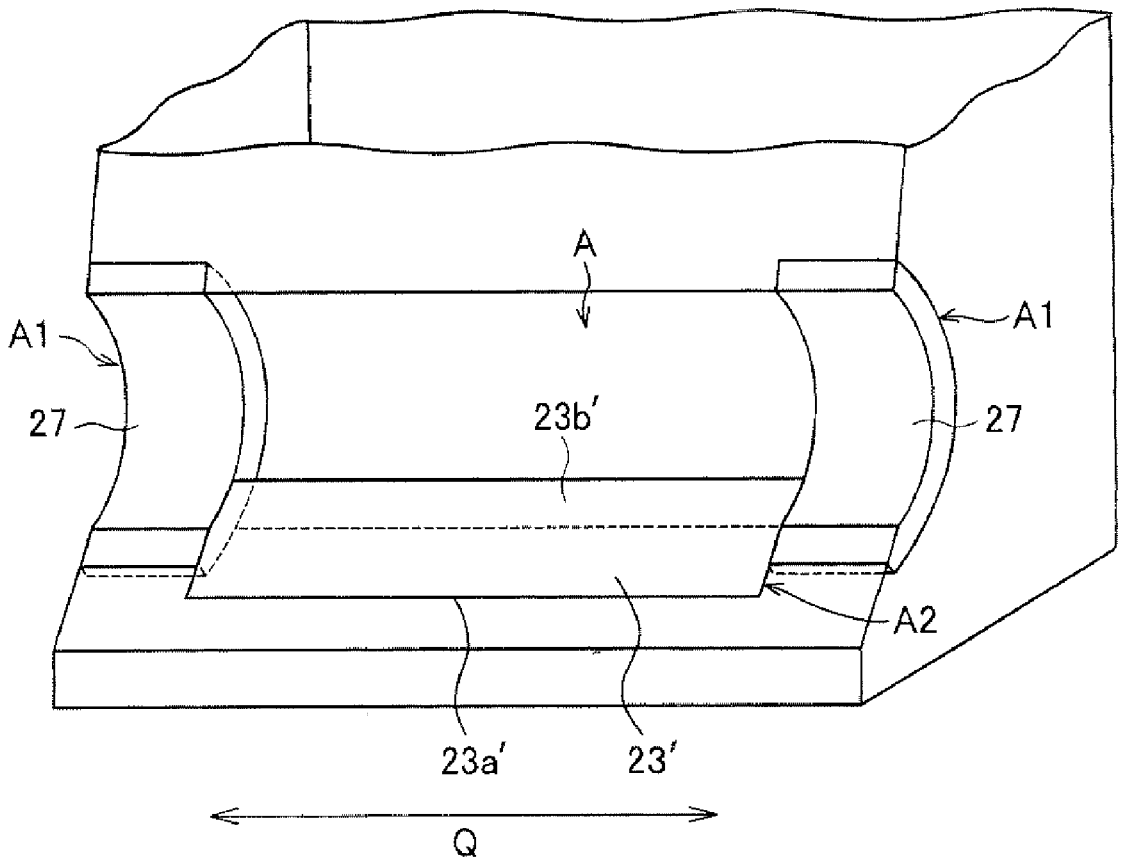
FIG. 6 is a perspective view illustrating a vicinity of the opening section of a toner tank in an alternative exemplary embodiment.

Note that, in the present embodiment, both side ends of the front seal board 23 are overlaid on the side seals 27. However, the side ends of the front seal board 23' may be adhered and fixed to the respective inner side (the sides near the opening section A) of the side seals 27, as shown in the alternative example embodiment of FIG. 6.

This structure also allows the front seal board 23 to be combined with the side seals 27, thereby preventing leakage of toner through the gap therebetween.

Further, in the present embodiment, a double face adhesive tape is used to adhere/fix both sides A1 of the opening section A to the side seals 27, to adhere/fix the return edge A2 of the opening section A to the front seal board 23, and to adhere/fix both ends of the front seal board 23 to the side seals 27. However, the present invention is not limited to this structure, but these members may be adhered/fixed by an adhesive agent (liquid adhesive, jelly-type adhesive etc.).

Further, in the present embodiment, the front seal board 23 is a polycarbonate thin board. However, the present invention is not limited to this structure, but may be any materials having flexibility.

Here, the following describes in detail the specifications of the layer thickness control member 4, the toner supply roller 47 and the developing roller 48 provided in the printer of the present embodiment.

As described, the toner used in the printer of the present embodiment is negatively-charged nonmagnetic toner made of a single component and having high resistance, whose average particle diameter is 7.5 μm.

The toner supply roller 47 carries out pre-charging of such toner, and supplies an appropriate amount of the toner to the surface of the developing roller 48, and also removes the residual toner on the developing roller 48 after the development.

The toner supply roller 47 has a structure in which a cylindrical carbon dispersion conductive urethane foam is provided on the periphery of the stainless shaft. The diameter of the stainless shaft is 8 mm, and a −350V bias voltage is applied (supplied) to the shaft. Further, the outer diameter of the urethane foam on the periphery thereof is 20 mm.

Further, the developing roller 48 has a structure in which a cylindrical carbon dispersion conductive urethane rubber is provided on the periphery of the stainless shaft. The diameter of the stainless shaft is 10 mm, and a −300V bias voltage is applied (supplied) to the shaft. Further, the urethane rubber on the periphery has a resistance of 106 Ωcm and a hardness=60 based on JIS-A standard, and the outer diameter of the periphery is 27 mm.

The developing roller 48 is compressed into the photoconductive drum (negatively-charged organic photoconductor) 41 that rotates at a peripheral speed=175 mm/sec. The developing roller 48 rotates in the same direction as that of the photoconductive drum 41, however, at a peripheral speed 1.3 times (228 mm/sec) that of the photoconductive drum 41, performing contact reverse development.

Further, the toner supply roller 47 comes in contact with the developing roller 48 with a contact depth=0.5 mm, and a contact width in the rotation direction=6 mm. Further, the toner supply roller 47 rotates at a peripheral speed 0.9 times (205 mm/sec) that of the developing roller 48 in the opposite direction of the rotation direction of the developing roller 48. This peripheral speed is determined to allow sufficient toner supply to the developing roller 48, and to prevent time degradation/fusion of the toner.

Further, the layer thickness control member 4 is provided in a downstream portion of the rotation direction of the developing roller 48 by in a counter contact manner. The position of the layer thickness control member 4 is La=15 mm away from the fixed end 4*a* of the attachment section in the toner tank. The layer thickness control member 4 is made of a stainless leaf spring (thickness=0.1 mm), and a −350V voltage is applied (supplied) thereto.

Further, the layer thickness control member 4 has a bending section 4*a* in contact with the developing roller 48, which section allows adjustment of the toner layer on the developing roller 48 to be a even layer of about 15 μm thick and having a changing quantity=10 to 151 μC/mg.

Further, the charging device shown in FIG. 3 may instead be a contact-type roller or brush. Further, the LSU may instead be an exposure unit having an EL, an LED writing head or the like, in which light emitting elements are aligned in an array manner. Further, the LSU may be a laser scanning unit including a laser irradiation section and a reflection mirror.

Further, a high-level bias voltage (a high voltage in opposite polarity (+) of the toner charging polarity (−)) is applied to the transfer roller shown in FIG. 3 so as to allow transfer of the toner image onto the sheet. The transfer roller has a metal (e.g., stainless) base axis which has a diameter=8 to 10 mm, and the surface thereof is covered by a conductive elastic material (e.g., EPDM, urethane foam etc.), thereby evenly applying a high-voltage to the sheet. Note that the transfer roller may however instead be a brush having the similar charging function.

Further, heat roller of the fixing device 56 is set to a predetermined fixing temperature by a control section (not shown) of the printer, based on a signal from a temperature detecting device (not shown). Further, the heat roller thermally compresses a sheet together with a pressure roller, so as to fuse/mix/compress a multiple-colored toner image having been transferred on the sheet, thereby thermally fixing the toner image to the sheet. Note that the sheet on which the multi-colored toner image has been fixed, which is then carried on the sub-carriage path S by the carriage roller 53, can be outputted to the output tray 62 in a reverse state (with the multi-colored toner image facing down).

Further, in the present embodiment, the developing unit 44 carries out development with a single component developer. However, the present invention is not limited to this arrangement, and the developing unit 44 may have an arrangement in which the development is carried out by using a two-components developer (e.g., toner and carrier).

Further, in the present embodiment, a printer is used as an exemplary embodiment. However, the present invention is not limited to usage in a printer. For example, the developing device of the present invention may be used in other printing devices, such as a photocopier, facsimile etc.

The transfer belt 73 may be expressed in other words as a transfer belt placed in contact with the photoconductive drums 41, for sequentially transferring the individual toner images of different colors formed on the photoconductive drums 41 onto the sheet (recording paper) by overlaying the toner images with each other, thus forming a color toner image (multiple-colored toner image).

Further, the front seal board 23 may be expressed in other words as a front seal board in which an end in the width direction (shorter side direction) is fixed to a sheet fixing plane (return edge A2) of the toner tank 49 by a double face adhesive tape. Further, the length in the longitudinal direction (longer side direction) of the front seal board 23 may be expressed as a length that is determined so that both ends thereof are overlapping the surface near the developing roller 48 of each side seal 27. On this account, each end in the longitudinal direction of the front seal board 23 is sandwiched between the developing roller 48 and the side seal 27 on the contact section of the developing roller 48.

Further, the developing unit 44 may be expressed as a unit having a function of preventing leakage of toner by fixing the overlaid portion of each end of the front seal board 23 and the side seal 27 by a double face adhesive tape, so that there is no gap will be generated between the front seal board 23 and the side seal 27 even when the developing unit 44 is driven for a long period of time or when some kind of vibration, impact etc. is applied thereto.

Further, the developing device may be expressed as one of the following first through fourth developing devices. The first developing device includes: a development container having an opening; a toner carrying body (developing roller), provided in the opening, for moving the toner to the development position by rotation; a flexible sheet member (front seal board), provided along the longitudinal direction of the toner carrying body, for preventing leakage of toner through the opening; and a side seal, provided in an end in the longitudinal direction of the toner carrying body in contact with the toner carrying body along the rotation direction thereof, wherein the end of the flexible sheet member is overlaid on the side seal member, and the contact plane is fixed by an adhesive.

With this arrangement in which the flexible sheet member and the side seal member have appropriate contact forces with respect to the toner carrying body, and the flexible sheet member and the side seal member are securely fixed by an adhesive, it is possible to prevent toner leakage between the minute gap between the flexible sheet member and the side seal member for a long period of time. More specifically, in an exemplary embodiment, the flexible sheet member and the side seal have appropriate contact forces with respect to the toner carrying body, and toner leakage due to vibration, impact etc. can be securely prevented not only during operation but also in moving the device.

Further, the second developing device has the same structure as that of the first developing device. It is however arranged so that the flexible sheet member is made of a material with Young's modulus=1.0 MPa or greater. With this arrangement, it is possible to prevent deformation of the flexible sheet member in the longitudinal direction due to compression force of the side seal.

Further, the third developing device has the same structure as that of the first developing device, it is however arranged so that the development is performed with a single-component toner, and the contact pressure of the flexible sheet member with respect to the toner carrying body is not more than 0.2 N/cm. With this arrangement, the collected toner on the toner carrying body will not be raked by the flexible sheet member, thereby securely re-collecting the toner into the developing device.

Further, the fourth developing device has the same structure as that of the first developing device. It is however arranged so that the flexible sheet member is made of a polycarbonate thin board. With this arrangement, it is possible to prevent deformation of the flexible sheet member in the longitudinal direction due to compression force of the side seal.

As described, the developing device of exemplary embodiments disclosed herein is a developing device for developing a latent image by obtaining developer from an opening section of a developer tank by a developing roller that is provided in a printing device, covering the opening section from outside of the developer tank, wherein: the developing device comprises: a seal mechanism for sealing a gap between the developing roller and the opening section, the seal mechanism including (a) side seals provided on both lateral sides of the opening section while being in contact with the developing roller, and (b) a front seal board whose one side covers an edge of the opening section and is fixed thereto, which edge extends in a longitudinal direction of the developing roller, the front seal board coming in contact with a surface of the developing roller between the opening section and the developing roller, when the developing roller returns to the opening section, and the front seal board being fixed to the side seals by its end sections.

The device of an exemplary embodiment includes side seals for covering the lateral gaps, and the front seal board for covering the return gap. Particularly, the lateral ends of the front seal board are partly fixed to the respective side seals.

More specifically, in the device of exemplary embodiments disclosed herein, the gap between the developing roller and the opening section of the developer tank is sealed by a unified plane composed of the side seals and the front seal board that are adhered to each other.

Therefore, in this device, there is no gap between the side seals and the front seal board due to vibration caused by external force, time degradation etc. (i.e., it prevents the side seals to be away from the front seal board).

On this account, in this device, toner leakage can be securely prevented even when the device is driven for a long period of time or when some kind of vibration is applied to the device (or to the printer including the device). It is preferable that the developing device is arranged so that the front seal board are fixed to the side seals with the end sections overlaid on the side seals.

With this arrangement, the fixing plane (contact plane) of the side seals and the front seal board can be widened compared to the arrangement in which the side seals and the front seal board are fixed by their end portions. On this account, they are more firmly fixed.

Further, it is preferable that the front seal board is made of a material having Young's modulus=not less than 1.0 MPa.

Further, it is preferable that the thin board is made of polycarbonate (polycarbonate thin board).

With this material, it is possible to prevent deformation (deformation in the longitudinal direction of the developing roller) of the front seal board due to compression of the side seals thereinto.

Further, when the developer device carries out development with a one-component toner development method, it is preferable that the contact pressure of the front seal board with respect to the developing roller is not more than 0.2N/cm.

With this arrangement, the residual toner on the return surface of the developing roller will not be raked by the front seal board, and the developing roller securely returns (collects) the remaining toner into the developer tank.

The exemplary embodiments are suitable for a developing device provided in a photocopier, printer etc., for developing an electrostatic latent image to form a visible image.

The embodiments and concrete examples of implementation discussed in the foregoing detailed explanation serve solely to illustrate certain technical details, which should not be narrowly interpreted within the limits of such embodiments and concrete examples, but rather may be applied in many variations within the spirit of the present invention, provided such variations do not exceed the scope of the patent claims set forth below.

What is claimed is:

1. A developing device for developing a latent image by obtaining developer from an opening section of a developer tank by a developing roller that is provided in a printing device, covering the opening section from outside of the developer tank, wherein:

the developing device comprises:

a seal mechanism for sealing a gap between the developing roller and the opening section, the seal mechanism including (a) side seals provided on both lateral sides of the opening section while being in contact with the developing roller, and (b) a front seal board whose one side covers an edge of the opening section and is fixed thereto, which edge extends in a longitudinal direction of the developing roller, the front seal board being configured to contact a surface of the developing roller between the opening section and the developing roller, and the front seal board being fixed to the side seals at its end sections, each of the side seals comprises a urethane foam and a flocked fabric laminated on the urethane foam, the flocked fabric being in contact with the developing roller.

2. The developing device as set forth in claim 1, wherein:

the developer tank includes a development supply roller for supplying developer to the developing roller.

3. The developing device as set forth in claim 1, wherein: the developer tank has a plane that faces the developing roller and is curved along a shape of the developing roller.

4. The developing device as set forth in claim 1, wherein: the end sections of the front seal board are fixed to the side seals with the end sections overlaid on the side seals.

5. The developing device as set forth in claim 1, wherein: the end sections of the front seal board are adhered/fixed to opening-section sides of lateral sides of the side seals.

6. The developing device as set forth in claim 1, wherein: the front seal board is characterized by a Young's modulus of not less than 1.0 MPa.

7. The developing device as set forth in claim 1, wherein: the device is configured to carry out development with a one-component toner development method, and a contact pressure of the front seal board with respect to the developing roller is not more than 0.2N/cm.

8. The developing device as set forth in claim 1, wherein: the front seal board comprises a flexible thin board.

9. The developing device as set forth in claim 8, wherein: the thin board comprises polycarbonate.

10. The developing device as set forth in claim 1, wherein: the front seal board is elastically in contact with the surface of the developing roller.

11. The developing device as set forth in claim 1, further comprising:

a layer thickness control member for adjusting thickness of a developer layer formed on the developing roller.

12. A printing device, comprising a developing device, wherein said developing device comprises:

a seal mechanism for sealing a gap between the developing roller and the opening section, the seal mechanism including (a) side seals provided on both lateral sides of the opening section while being in contact with the developing roller, and (b) a front seal board whose one side covers an edge of the opening section and is fixed thereto, which edge extends in a longitudinal direction of the developing roller, the front seal board section and the developing roller, and the front seal board being fixed to the side seals at its end sections, each of the side seals comprises a urethane foam, and a flocked fabric laminated on the urethane foam, the flocked fabric being in contact with the developing roller.

13. The printing device as set forth in claim 12, wherein: the end sections of the front seal board are fixed to the side seals with the end sections overlaid on the side seals.

14. The printing device as set forth in claim 12, wherein: the end sections of the front seal board are adhered/fixed to opening-section sides of lateral sides of the side seals.

15. The printing device as set forth in claim 12, wherein: the front seal board is characterized by a Young's modulus of not less than 1.0 MPa.

16. The printing device as set forth in claim 12, wherein: the device is configured to carry out development with a one-component toner development method, and a contact pressure of the front seal board with respect to the developing roller is not more than 0.2N/cm.

17. The printing device as set forth in claim 12, wherein: the front seal board comprises a flexible thin board.

18. The printing device as set forth in claim 17, wherein: the thin board comprises polycarbonate.

19. The printing device as set forth in claim 12, wherein: the front seal board is elastically in contact with the surface of the developing roller.

20. The printing device as set forth in claim 12, further comprising:

a layer thickness control member for adjusting thickness of a developer layer formed on the developing roller.

* * * * *